US011060759B2

(12) United States Patent
Yaich

(10) Patent No.: US 11,060,759 B2
(45) Date of Patent: Jul. 13, 2021

(54) BOILER HEATING SYSTEM

(71) Applicant: Hertzel Yaich, Kfar Saba (IL)

(72) Inventor: Hertzel Yaich, Kfar Saba (IL)

( * ) Notice: Subject to any disclaimer, the term of this patent is extended or adjusted under 35 U.S.C. 154(b) by 0 days.

(21) Appl. No.: 16/765,899

(22) PCT Filed: Apr. 12, 2019

(86) PCT No.: PCT/IL2019/050416

§ 371 (c)(1),
(2) Date: May 21, 2020

(87) PCT Pub. No.: WO2019/215715

PCT Pub. Date: Nov. 14, 2019

(65) Prior Publication Data

US 2020/0363098 A1 Nov. 19, 2020

(30) Foreign Application Priority Data

May 10, 2018 (IL) ..... 259265

(51) Int. Cl.
*F24H 1/20* (2006.01)
*F24B 9/00* (2006.01)
*F24H 1/18* (2006.01)

(52) U.S. Cl.
CPC ..... *F24H 1/205* (2013.01); *F24B 9/006* (2013.01); *F24H 1/182* (2013.01); *F24H 1/201* (2013.01)

(58) Field of Classification Search
CPC ..... F24H 1/182; F24H 1/205; F24H 1/201; F24H 1/26; F24H 1/263; F24H 1/30; F24H 1/32; F24H 1/34; F24H 1/12; F24H 1/122; F24H 1/121; F24H 1/124; F24H 1/125; F24H 1/127; F24H 1/128; F24B 9/006

See application file for complete search history.

(56) References Cited

U.S. PATENT DOCUMENTS 1,779,937 A * 10/1930 Holinger ..... F24H 1/205 122/4 R
1,805,222 A * 5/1931 Morley ..... F24H 1/205 122/159
1,980,424 A 11/1934 Morgan
(Continued)

FOREIGN PATENT DOCUMENTS

CN 109140575 A 1/2019

*Primary Examiner* — Steven S Anderson, II
(74) *Attorney, Agent, or Firm* — Alphapatent Associates, Ltd.; Daniel J. Swirsky

(57) ABSTRACT

In one aspect, the present invention is directed to boiler heating system, comprising: a hollowed-walls cylinder, for storing therein water to be heated; a partition in a form of a cylinder, disposed inside the hollowed-walls cylinder, distantly from its vertical walls; the partition having an upper water passage and a lower water passage, for allowing water transition between the inner side of the partition and the outer side of the partition; a heating element disposed inside the inner space of the hollowed-walls cylinder; a water inlet, disposed in the lower side of the hollowed-walls cylinder; and a water outlet, disposed in an upper side of the hollowed-walls cylinder, thereby (a) allowing heating the water without being in direct contact between the heating element and the water, resulting with no scale accumulation, and (b) separation between ascending water and descending water, thereby accelerating the water warming.

6 Claims, 8 Drawing Sheets

(56) References Cited

U.S. PATENT DOCUMENTS

| | | | | | |
|---|---|---|---|---|---|
| 2,077,323 | A * | 4/1937 | Hendrix | F24H 1/205 | 122/18.31 |
| 2,625,138 | A * | 1/1953 | Jacoby | F24H 1/205 | 122/14.22 |
| 2,642,046 | A * | 6/1953 | Alexander | F24H 1/207 | 122/15.1 |
| 2,814,278 | A * | 11/1957 | Cameron | F24H 1/205 | 122/19.1 |
| 3,621,566 | A * | 11/1971 | Welsh | H05B 3/00 | 29/610.1 |
| 5,372,185 | A * | 12/1994 | Lannes | F24D 3/082 | 122/15.1 |
| 7,000,572 | B1 * | 2/2006 | Schimmeyer | F22B 7/18 | 122/155.2 |
| 2010/0006041 | A1 * | 1/2010 | Eisenbraun | F24H 9/124 | 122/14.3 |
| 2013/0266296 | A1 * | 10/2013 | Kreutzman | H05B 3/78 | 392/308 |

* cited by examiner

BOILER HEATING SYSTEM

TECHNICAL FIELD

The present invention relates to the field of boiler heating technology.

BACKGROUND ART

Presently, boiler heating systems are mainly based on electricity heating and gas heating. These systems are characterized by having many drawbacks. For example, one of the drawbacks is the heating rate, and therefore many attempts have been made to increase the rate of warming of the water.

In addition, after several heating sessions with an electrical heating element, scale is accumulated on the heating element. The scale isolates the heating element from the water to be heated, and therefore not only the warming rate is slowed, but also more energy is consumed.

Furthermore, in order to replace a heating element which has been covered with scale, the water in the boiler must be emptied, and therefore this water is wasted. In addition, scale cleaning is a difficult and cumbersome action, and sometimes therefore it is common to replace the entire heating element.

In summary, the present water heating technologies are characterized by slow heating rate, waste of energy, amortization and maintenance.

It is an object of the present invention to provide a solution to the above-mentioned and other problems of the prior art.

Other objects and advantages of the invention will become apparent as the description proceeds.

SUMMARY OF THE INVENTION

In one aspect, the present invention is directed to boiler heating system (100), comprising:

a hollowed-walls cylinder (12), for storing therein water to be heated;

a partition (13) in a form of a cylinder, disposed inside the hollowed-walls cylinder (12), distantly from its vertical walls;

the partition having an upper water passage (18) and a lower water passage (19), for allowing water transition between the inner side of the partition (chamber H) and the outer side of the partition (chamber A);

a heating element (15) disposed inside the inner space of the hollowed-walls cylinder (chamber C);

a water inlet (10), disposed in the lower side of the hollowed-walls cylinder (12); and a water outlet (11), disposed in an upper side of the hollowed-walls cylinder (12), thereby (a) allowing heating the water without being in direct contact between the heating element and the water, resulting with no scale accumulation, and (b) separation between ascending water and descending water, thereby accelerating the water warming.

The system may further comprise a lid (17) of the inner space (chamber C) in which the heating element (15) is disposed, for adjusting a heating rate of the system.

The system may further comprise means for adjusting the space inside the partition, such as a telescopic form of the partition, thereby adjusting the heating rate of the water. An example can be seen in FIG. 8, element 13*a*.

The heating element may be electric as well as based on combustion, such as a flame.

According to one embodiment of the invention, the space of chamber A is divided by partitions (24) each having a hole (25), thereby moderating the cooling rate of the heated water.

According to one embodiment of the invention, the heating element (15) is in a form of a spiral.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Preferred embodiments, features, aspects and advantages of the present invention are described herein in conjunction with the following drawings.

It should be understood that the drawings are not necessarily drawn to scale.

DESCRIPTION OF EMBODIMENTS

The present invention will be understood from the following detailed description of preferred embodiments ("best mode"), which are meant to be descriptive and not limiting. For the sake of brevity, some well-known features, methods, systems, procedures, components, circuits, and so on, are not described in detail.

The System Structure

The tank of the system 100 is in the form of a vertical cylinder having hallowed walls, which stores the water. Thus, while the prior art boiler have a tank in a form of a vessel, a water tank according to the present invention is a vertical cylinder having hollowed walls, in which the water is disposed. Accordingly, the center of the tank is a hollowed cylinder.

A heating element is placed inside the space in the center of the hollowed cylinder. Thus, the heating element can be electric, such as a spiral, or even fire.

The space of the hollowed walls of the cylinder is divided by a partition in a form of a vertical cylinder. Nevertheless, the partitioning cylinder allows water passage from its upper side and from its lower side, in order to allow circulation, as detailed hereinafter.

Figure 1:
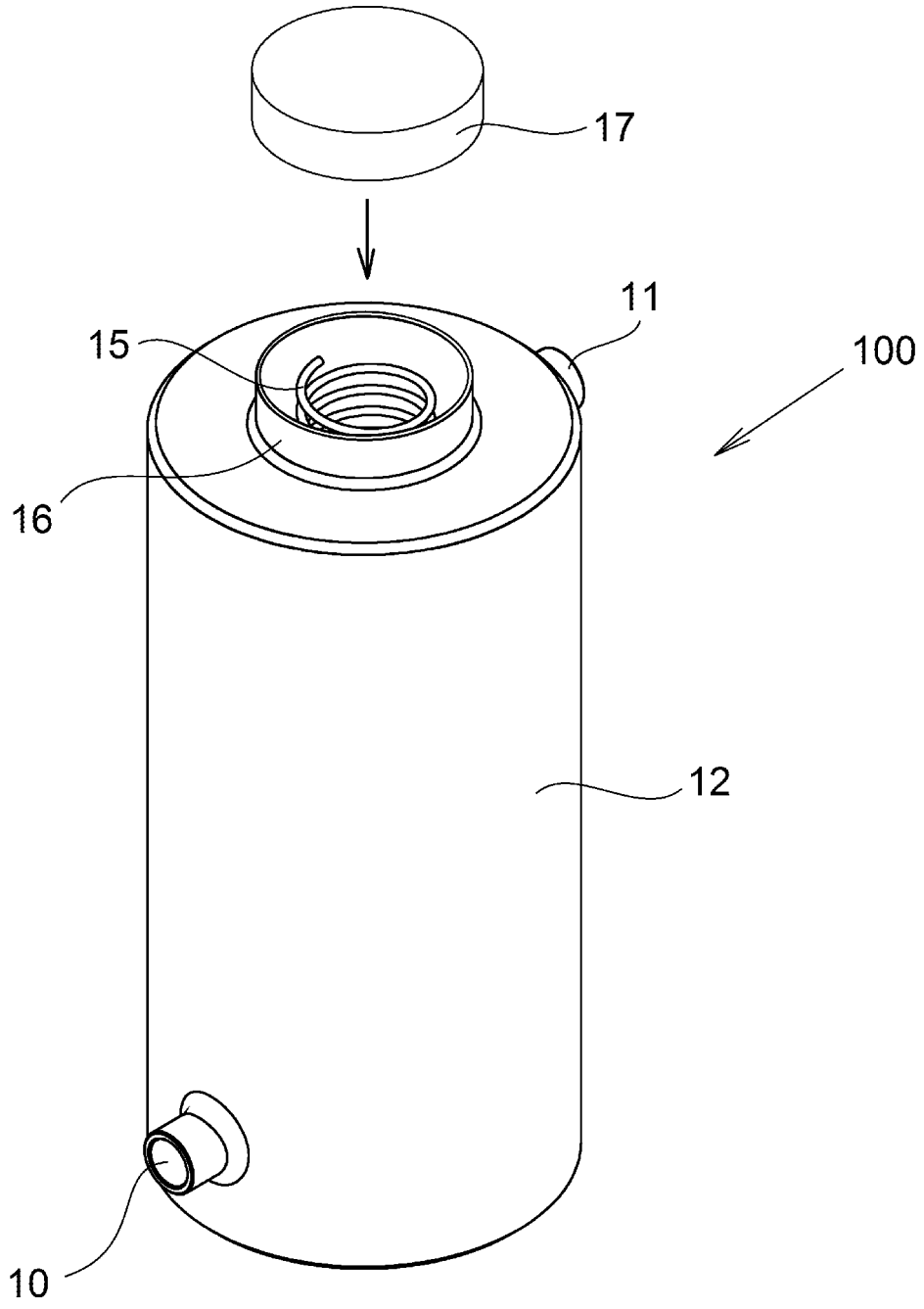
FIG. 1 pictorially illustrates a boiler heating system 100, according to one embodiment of the invention.

FIG. 1 pictorially illustrates a boiler heating system 100, according to one embodiment of the invention.

Figure 2:
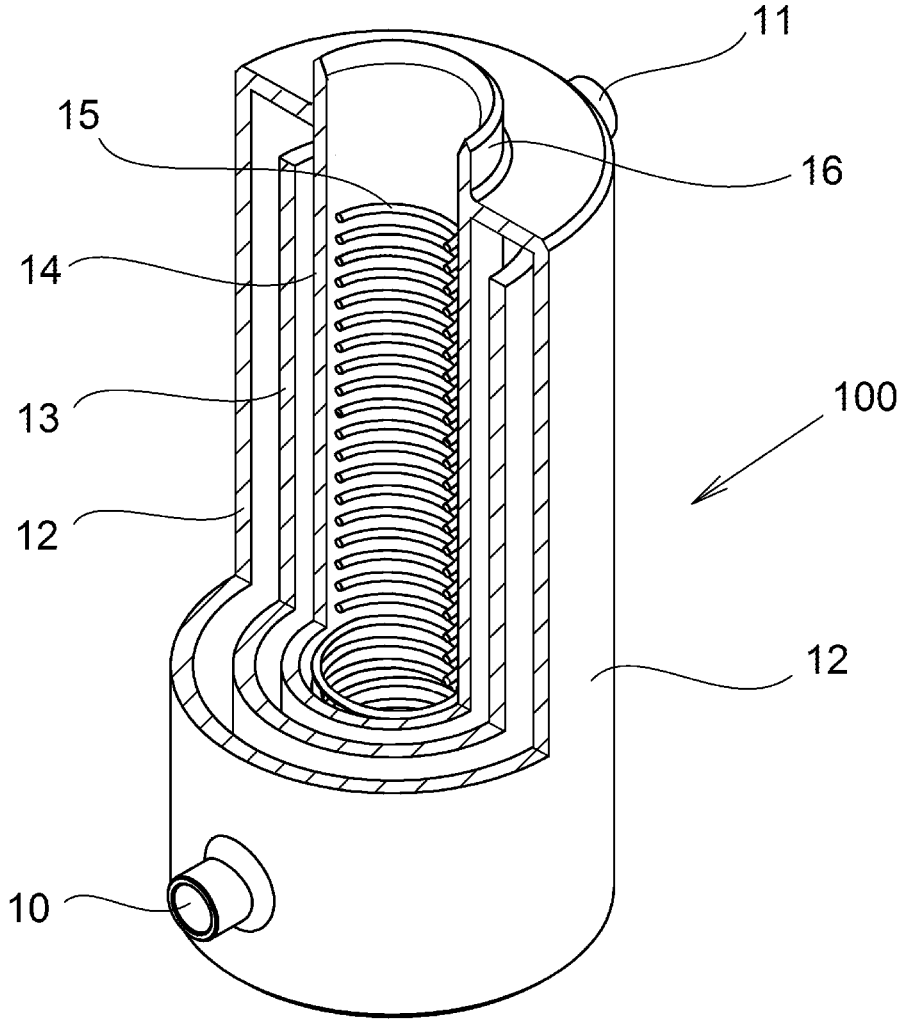
FIG. 2 is a sectioned view of the boiler heating system.

FIG. 2 is a sectioned view of the boiler heating system.

Figure 3:
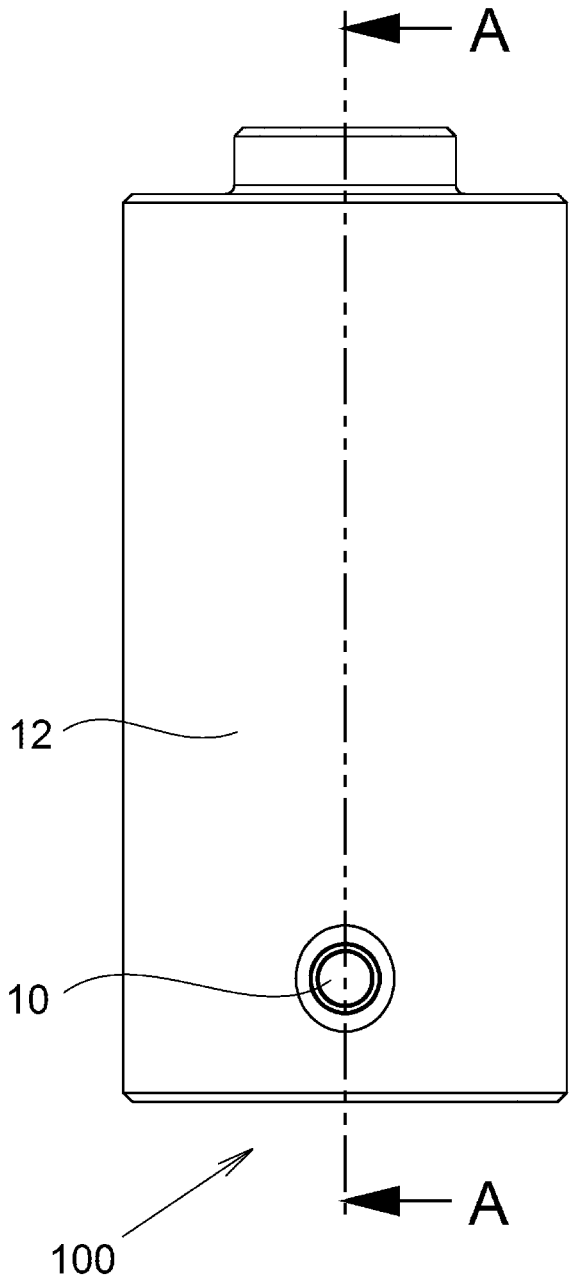
FIG. 3 is a front view of the boiler heating system, in which is defined a section A-A.

FIG. 3 is a front view of the boiler heating system, in which is defined a section A-A.

Figure 4:
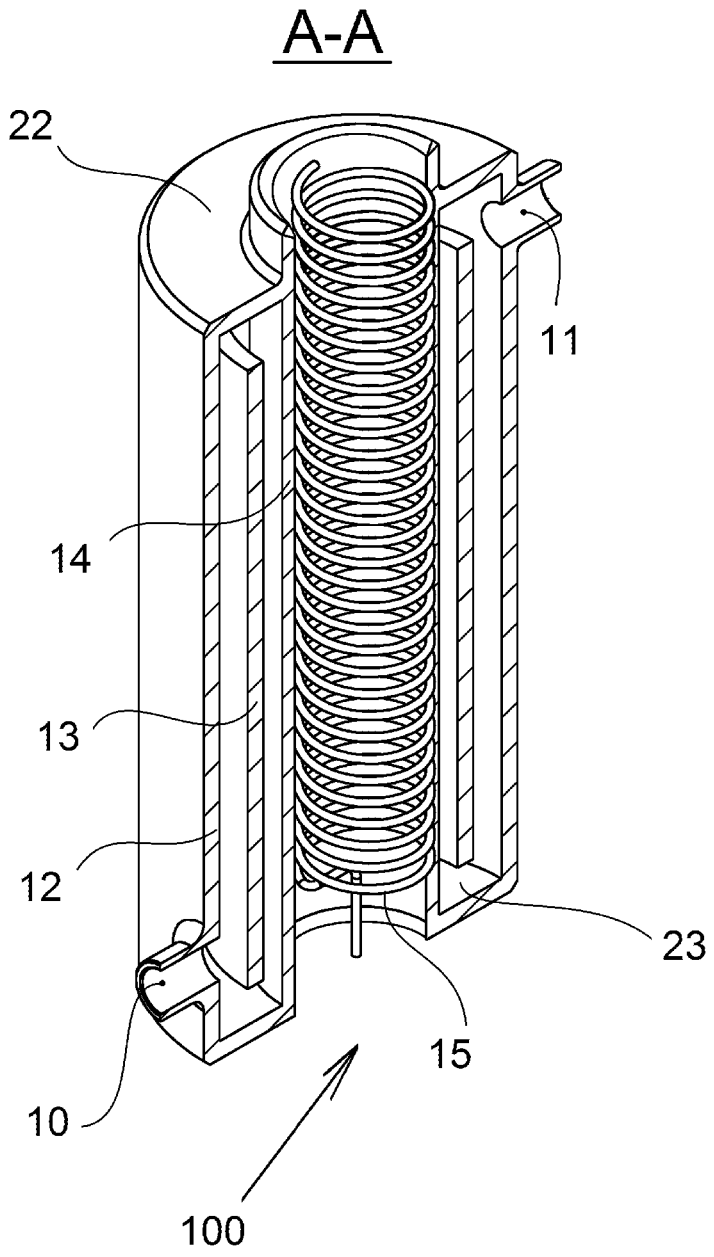
FIG. 4 is a perspective view of section A-A.

FIG. 4 is a perspective view of section A-A.

Figure 5:
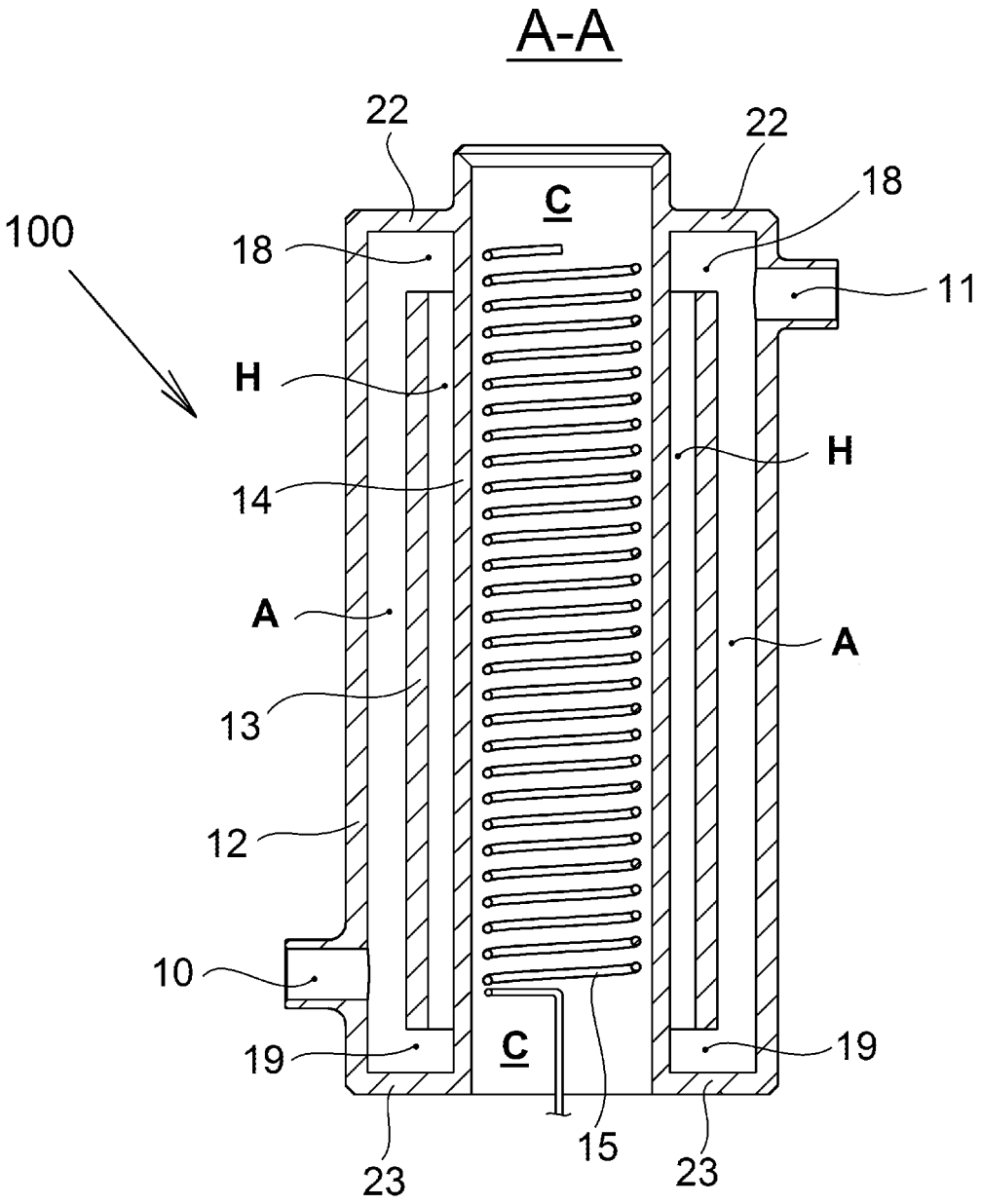
FIG. 5 is a front view of section A-A.

FIG. 5 is a front view of section A-A.

The water tank is confined by the external cylinder wall 12 and internal cylinder wall 14, and the upper and lower "lids" 22 and 23 respectively.

Inside the water tank is disposed a partition in a form of a vertical cylinder 13. The partition prevents water passage through it. The partition 13 does not meet the "lids" 22 and 23, and more particularly, there are gaps 18 and 19 between cylinder 13 and the "lids" 22 and 23, for allowing water passage through the gaps. The gaps are better seen in FIG. 5.

According to one embodiment of the invention, the partition 13 meets the "lids" 22 and 23, and the gaps are replaced by holes in the upper and lower side of the partition 13. For the sake of brevity, this embodiment is not illustrated.

As such, this structure defines three chambers:

Chamber C, which is the interior side of cylinder 14. Chamber C is referred herein as a Combustion Chamber;

Chamber H, which is confined by cylinders 13 and 14, i.e., the space between the partition 13 and the cylinder 14. This chamber is referred herein as Heating Chamber; and Chamber A which is the space confined by cylinder 12 and cylinder 14, excluding the space of chamber H. This chamber is referred herein as Accumulating Chamber.

The tank is the space of chambers A and H.

Reference numeral 10 denotes an inlet through which non-heated water enter into the water tank of the boiler, and reference numeral 11 denotes an outlet from the tank, through which heated water exits the tank.

The System Operation

Figure 6:
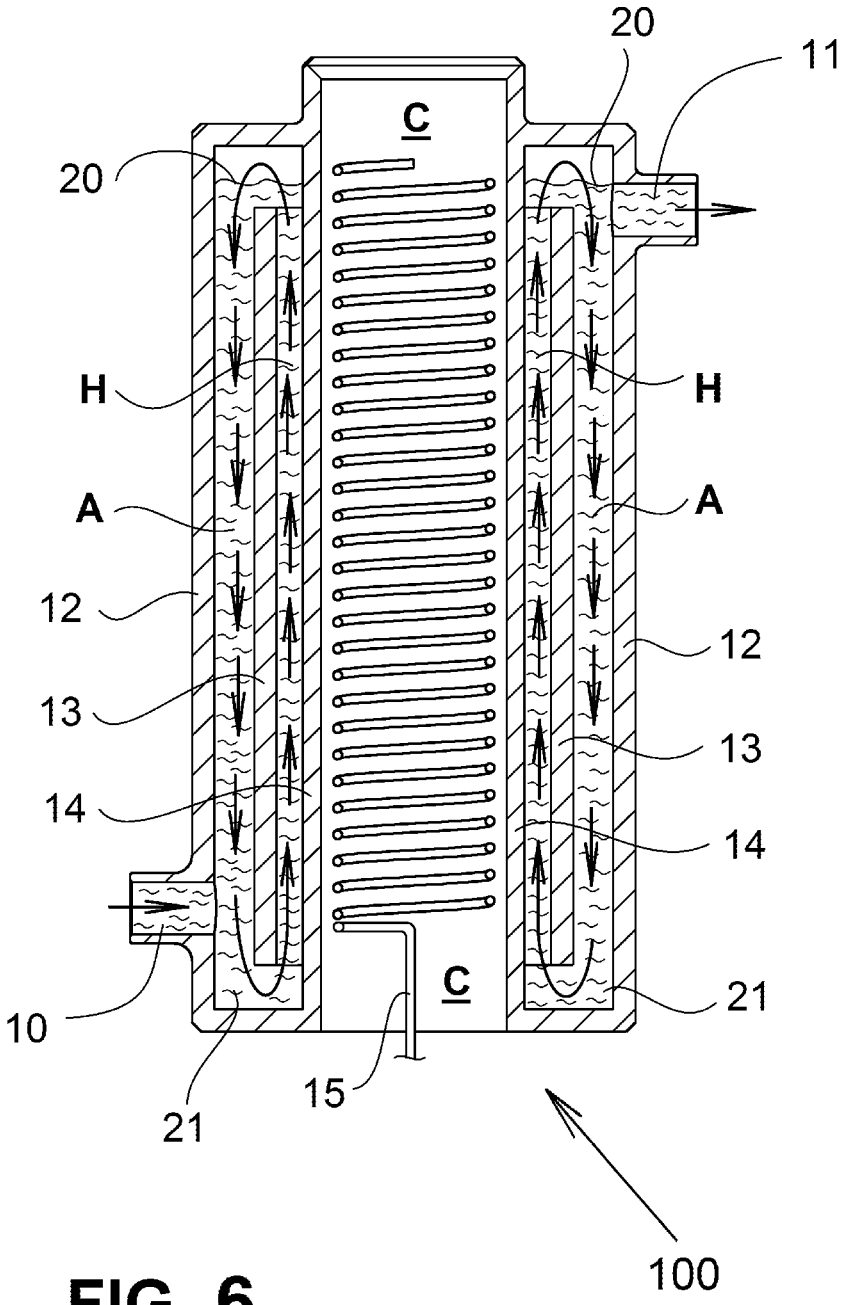
FIG. 6 is a front view of section A-A in which is illustrated the water circulation thereof.

FIG. 6 is a front view of section A-A in which is illustrated the water circulation of the illustrated system.

Cylinder 14 is heated by the heating element 15. As a result, the water disposed in chamber H is heated, and therefore moves upwards.

Due to the apertures 18 and 19 between the partition 13 and the "lids" 22 and 23, the heated water of chamber H is in contact with the water of chamber A. As a result the water of chamber A, which is colder than the water of chamber H, moves downwards. Thus, the water inside the tank circulates as illustrated in this figure by the arrows.

The relation between the space of the heating chamber H and the space of the accumulating chamber A determines the heating rate of the water in the tank.

Since in the present invention the water of the tank is not in direct contact with the heating element 15, no scale is generated. As a result, the system lasts longer than systems in which water is heated while being in direct contact with the heating element. Furthermore, in the present invention lesser maintenance activity is required, since the main maintenance activity in the prior art boilers is due to the accumulated scale.

The present invention heats a boiler's water in less time than a prior art boiler with the same characteristics, so the energy consumed by the present invention is lesser in comparison to the prior art boiler. The reason thereof is separation between ascending water and descending water inside the boiler, in contrast to prior art boilers in which ascending water is mixed with descending water and therefore interfere with each other.

Referring again to FIG. 1, the lid 17 is used to close the combustion chamber C, thereby maintaining the heated air in the combustion chamber, and therefore using less energy for heating the boiler. The lid 17 can be partially released such that a generated aperture between the lid and the "neck" 16 is adjusted, thereby adjusting the heating speed of the water of the boiler.

According to a preferred embodiment of the invention, the dimensions of partition 13 are adjustable. By adjusting a dimension of partition 13, the relation between the volume of chamber A and chamber H are changed, and therefore the heating speed of the system is changed.

Figure 8:
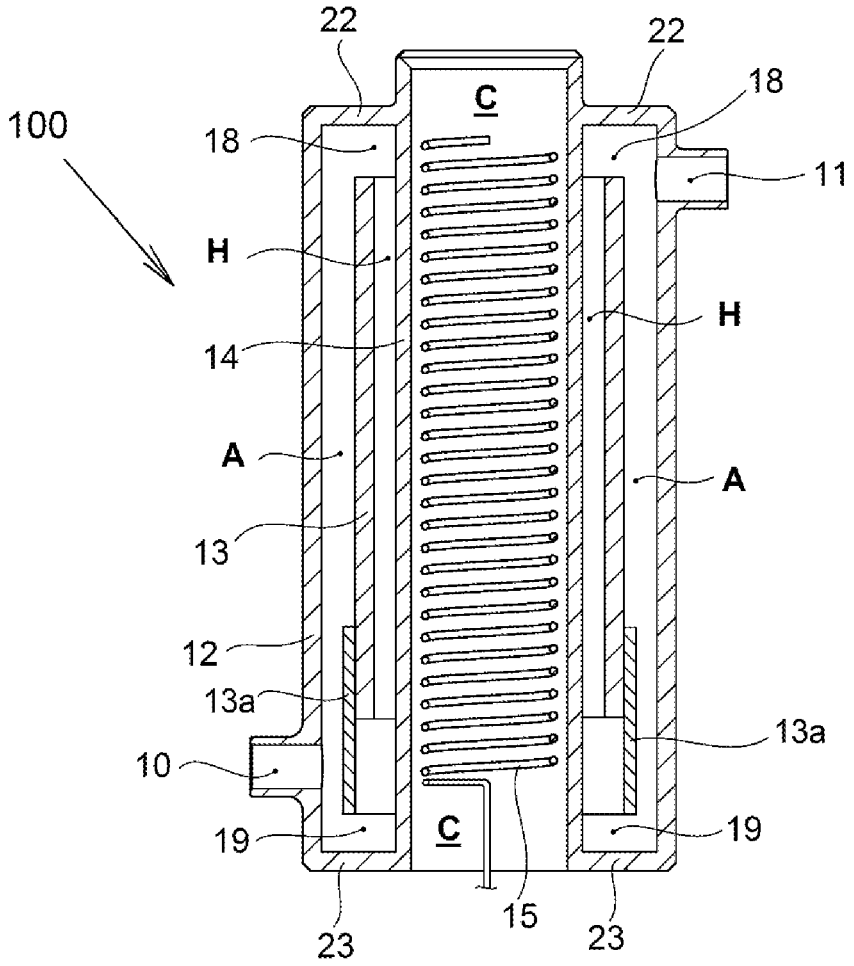
FIG. 8 is a sectioned view of a boiler heating system in which the partition is in a telescopic form, according to a further embodiment of the invention.

Adjusting the partition's dimensions can be carried out by a variety of ways. For example, the partition wall 13 may be designed as telescopic, and therefore its length is adjustable. FIG. 8 shows the partition 13 designed as a telescopic component.

Figure 7:
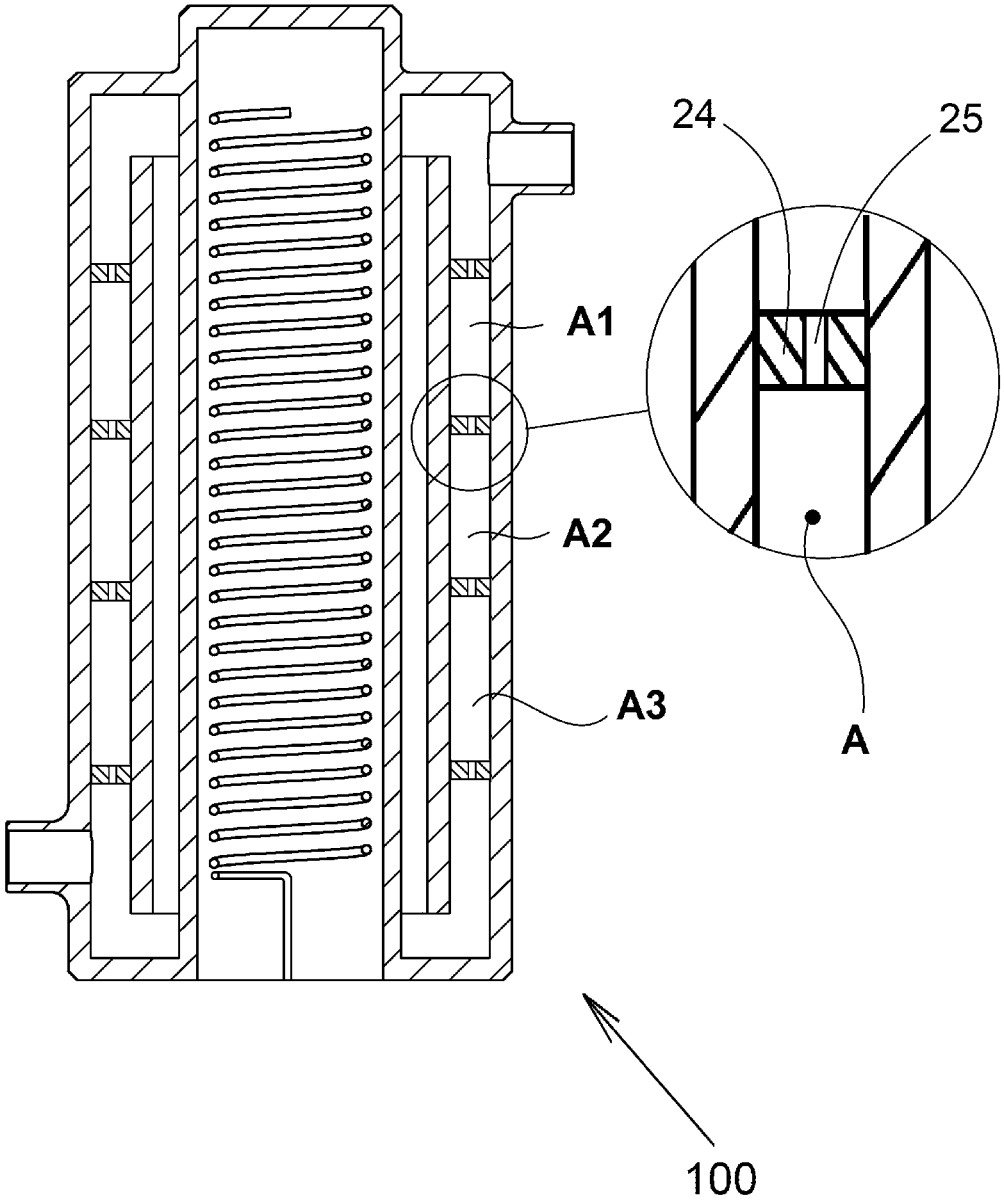
FIG. 7 is a sectional view of a boiler heating system, according to a further embodiment of the invention.

FIG. 7 is a sectional view of a boiler heating system, according to a further embodiment of the invention.

FIG. 7 also illustrates a zoomed view of a part of the system.

As shown, a plurality of partitions 24 is installed in chamber A. Each partition comprises a bore 25 which is used as water passage between the sub chambers. The partitions divide the space of chamber A to sub-chambers A1, A2, . . . , An.

Since the sub chambers are separated from each other, this arrangement provides some isolation which moderates the cooling rate of the heated water.

Preferably, the cylinders 12, 13 and 14, and also the facets 22 and, 23 are made of metal, but of course other materials known in boilers industry may be used.

In the figures and/or description herein, the following reference numerals and letters (Reference Signs List) have been mentioned:

numeral 100 denotes boiler heating system, according to one embodiment of the invention;

the letter C denotes a combustion chamber;

the letter H denotes a heating chamber;

the letter A denotes an accumulating chamber;

numeral 10 denotes an inlet to the heating system 100;

numeral 11 denotes an outlet from the heating system 100;

numeral 12 denotes a first cylinder;

numeral 13 denotes a second cylinder operable as a partition, and numeral 13*a* denotes an extension thereof;

numeral 14 denotes a third cylinder;

numeral 15 denotes a heating element;

numeral 16 denotes a neck correspondingly to lid 17;

numeral 17 denotes a lid;

numeral 18 denotes a space between the upper edge of the second cylinder 13 and the upper wall of chamber A;

numeral 19 denotes a space between the lower edge of the second cylinder 13 and the lower wall of chamber A;

numeral 20 denotes a water line;

numeral 21 denotes water inside the boiler;

numeral 22 denotes a top "lid" (facet) of vertical cylinder confined between cylinders 12 and 14;

numeral 23 denotes a bottom "lid" (facet) of vertical cylinder confined between cylinders 12 and 14;

numeral 24 denotes a partition which separates chamber A into sub chambers; and numeral 25 denotes a water passage in each of the partitions 24.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The invention claimed is:

1. A boiler heating system, comprising:

a hollowed-wall cylinder comprising an outer wall and an inner wall having a hollow space formed therebetween, for storing therein water to be heated and a first chamber defined by said inner wall and isolated from said hollow space to prevent liquid flow between said hollow space and said first chamber;

a partition in a form of a telescopic cylinder, disposed concentrically within said hollow space, spaced-apart from said outer and said inner wall of said hollowed-wall cylinder, whereby a second chamber is defined between said outer wall of said hollowed-wall cylinder and said partition, and a third chamber is defined between said partition and said inner wall of said followed-wall cylinder;

said partition having an upper water passage and a lower water passage, for allowing water transition between said second chamber and said third chamber thereby allowing circulation of water through said second chamber, upper water passage, third chamber and lower water passage;

a heating element disposed inside said first chamber;

a water inlet, disposed in a lower side of said hollowed-wall cylinder allowing water flow into said hollow space; and a water outlet, disposed in an upper side of said hollowed-wall cylinder allowing water flow out of said hollow space.

2. The system according to claim 1, wherein said heating element is electric.

3. The system according to claim 1, wherein said heating element source is combustion.

4. The system according to claim 1, wherein a space of said outer side of said partition is divided by partitions with a hole, thereby moderating a cooling rate of heated water.

5. The system according to claim 1, wherein said heating element is in a form of a spiral.

6. The system according to claim 1, further comprising a lid of said inner space in which said heating element is disposed.

* * * * *